United States Patent [19]

Mayer et al.

[11] Patent Number: 4,691,950

[45] Date of Patent: Sep. 8, 1987

[54] DEVICE FOR DETACHABLY SECURING PIVOTALLY CONNECTED MEMBERS IN A PREDETERMINED RELATIVE POSITION

[75] Inventors: Siegfried Mayer, Münster-Wolbeck; Paul Greisner, Telgte, both of Fed. Rep. of Germany

[73] Assignee: Aug. Winkhaus GmbH & Co. KG

[21] Appl. No.: 867,912

[22] Filed: May 27, 1986

[30] Foreign Application Priority Data

Jun. 14, 1985 [DE] Fed. Rep. of Germany ..... 3521492

[51] Int. Cl.[4] ..... E05C 17/16

[52] U.S. Cl. ..... 292/269; 292/277; 292/63; 292/DIG. 47

[58] Field of Search ..... 292/269, 277, 63, 65, 292/67, DIG. 15, DIG. 47, 338

[56] References Cited

U.S. PATENT DOCUMENTS

| | | | |
|---|---|---|---|
| 1,570,502 | 1/1926 | Koeb | 292/DIG. 47 X |
| 2,398,602 | 4/1946 | Sibley et al. | 292/269 X |
| 2,505,320 | 4/1950 | Bernhard | 292/269 |
| 4,435,007 | 3/1984 | Bascou | 292/277 X |
| 4,605,252 | 8/1986 | Yamamoto | 292/338 |
| 4,607,870 | 8/1986 | Crisp, Jr. et al. | 292/338 |

FOREIGN PATENT DOCUMENTS

| | | | |
|---|---|---|---|
| 812644 | 5/1969 | Canada | 292/DIG. 47 |
| 3028011 | 2/1982 | Fed. Rep. of Germany | 292/269 |
| 84177292 | 7/1984 | Fed. Rep. of Germany . | |
| 1227781 | 8/1960 | France | 292/277 |
| 2531131 | 2/1984 | France | 292/338 |
| 506874 | 6/1939 | United Kingdom | 292/338 |

*Primary Examiner*—Gary L. Smith
*Assistant Examiner*—Carl M. DeFranco, Jr.
*Attorney, Agent, or Firm*—Toren, McGeady & Associates

[57] ABSTRACT

The invention provides a device for securing a window sash to the outer frame of the window so that, on the one hand the sash may be locked in a predetermined open position and on the other hand may be pivoted to open it fully. A single push-button serves both to disengage a catch in the predetermined open position and to release the sash for full opening.

12 Claims, 5 Drawing Figures

DEVICE FOR DETACHABLY SECURING PIVOTALLY CONNECTED MEMBERS IN A PREDETERMINED RELATIVE POSITION

BACKGROUND OF THE INVENTION

This invention concerns a device for detachably securing pivotally connected first and second members in a predetermined relatively open position into which they have been moved from a relatively closed position. Thus, although the invention is not so restricted, it relates more particularly to a device for doors, windows or the like which may be secured to an outer frame in a predetermined open angular position.

German Utility Model No. 84 17 729 discloses a device comprising an opening bar one end of which is coupled by means of a swivel joint to a first of two corresponding frame members (e.g. the sash or door and the outer frame of a window) and the other end of which is connected to the second of these corresponding frame members by a swivel-slide joint, locking means, which automatically immobilize the position of the opening bar in relation to the frame members when the sash or door moves from the closed position into the predetermined open angular position, and manually operable releasing means for releasing these locking means.

With the known device, however, it is only possible to open the sash to the predetermined open angular position.

At any rate it is impossible for an ordinary non-expert individual living in a dwelling fitted with the window to open the sash beyond that point without considerable difficulty.

The object of the present invention is therefore to provide a device of the above-described type which allows the sash to be opened without difficulty to a wider open angular position, especially to a fully open position.

SUMMARY OF THE INVENTION

According, therefore, to the present invention, there is provided a device for detachably securing pivotally connected first and second members in a predetermined relatively open position into which they have been moved from a relatively closed position, the said device comprising a slide guide adapted to be secured to the first member; a sliding member slidable longitudinally of said slide guide; resilient means for urging the sliding member towards a normal position in the slide guide; a swivel joint carried by said sliding member; a swivel-slide joint adapted to be secured to the second member; a bar one end of which is connected to the swivel joint and the other end of which is connectable to and disconnectable from the swivel-slide joint; a releasing and locking cam carried by the bar, the slide guide having a cam-engaging edge which is engageable with the cam so as automatically to lock the bar in a predetermined angular position only when the bar has been moved into the latter in a predetermined direction as a result of the first and second members having been moved into the said relatively open position; the cam having a cam surface which cooperates with the cam-engaging edge during the movement of the bar in the said predetermined direction to cause movement of the sliding member against the action of the resilient means until the bar is in the said predetermined angular position; and manually operable releasing means for effecting sliding movement of the sliding member away from the said normal position and against the action of the resilient means to release the cam from the cam-engaging edge and thus permit the bar to be swivelled around the swivel joint so that the first member may be moved from the relatively open to the relatively closed position; the bar being removable from the swivel-slide joint when the first and second members are in the relatively closed position by moving the sliding member out of its normal position against the action of the resilient means.

Preferably, the first and second members are respectively constituted by a sash and an outer frame of a window.

The device according to the invention can be fitted to the most varied types of windows, especially simple pivoted windows with a vertical axis of rotation, balance windows with a horizontal tilting axis, tilt and turn windows with a horizontal tilting axis and a vertical rotational axis and swing windows with a horizontal swing axis. In every case the device can be so arranged that the axes of the swivel joint and the swivel-slide joint are parallel to the respective axis of rotation, but also so that the axes of the swivel joint and the sweivel-slide joint are substantially perpendicular to the rotational axis of the sash.

The releasing and locking cam can be constructed with a release curve and a stop catch adjacent thereto. When the sash or other first member is moved into the predetermined relatively open position, the release curve may cooperate with the cam engaging edge to release the sliding member from its normal position against the action of the resilient means. When the predetermined relatively open position is reached, the stop catch may be arranged to engage the cam engaging edge and thus immobilize the bar.

A simple embodiment of the swivel-slide joint consists on the one hand of an open forked slide slot in a fitting attached to the second member and on the other hand of a slot engaging bolt on the said other end of the bar, i.e. the end which is freely movable in relation to the first member. The slot engaging bolt can move out of the open fork end when the sliding member is manually released from its normal position against the action of the resilient means.

In a simply constructed, acceptably sized embodiment of the bar, the latter is provided with two parallel sections. At one end of the bar these sections may be arranged to receive the sliding member between them and at the other end they may be connected to each other by the slot engaging bolt. The fitting may have a portion which engages between the two sections.

The end of the sliding member which is remote from the bar may be formed as a manually operable releasing button. This releasing button can be used ont only to release the lock when the sash, door or other first member is in the locked, predetermined relatively open position but also, when the sash, door or other first member is in the relatively closed position, to enable the sash, door or other first member to open fully, i.e. beyond the predetermined relatively open position. This makes matters particularly easy, insofar as one and the same manually operated member may be used for two different functions.

In order to obtain a sturdy and aesthetically pleasing structure it is proposed that the slide guide comprise a cross-sectionally rectangular, elongate housing which receives the whole length of the bar when the sash, or other first member is in the relatively closed position and has an opening in a longitudinal side wall for the bar to pass therethrough. Only part of the length of the elongate housing then serves as a slide guide, the rest of its length serving to conceal and possibly to support the bar. One of the end edges of the opening, which edge is closed to the sliding member, can be formed as a cam engaging edge.

In order to be able to secure the sash, or door, or other first member in the predetermined relatively open position and/or in the relatively closed position and to protect it against unintentional opening from the inside and/or from the outside, it is proposed that in its normal position the sliding member be securable in relation to the slide guide. In this case, the bar, when the sliding member is in the normal position, either assumes a position parallel to the first member corresponding to the relatively closed position and is locked in this parallel position by the cooperation of the release curve and the cam engaging edge, or the bar is immobilized in the predetermined relatively open position by the cooperation of the stop catch and the cam engaging edge. Such a fastening serves for example as protection against unintentional opening of a sash or door by children.

The fastening can be formed for example by a grub screw in the sliding member, especially a grub screw with a socket head. This grub screw can be screwed into engagement with a corresponding opening in the slide guide.

In order to be able to use the device on both the left and the right, it is proposed that it be constructed symmetrically in relation to a plane of symmetry perpendicular to the axes of the swivel and swivel-slide joints.

In order to ensure ease of access to release the sash or door from the predetermined relatively open position, it is advantageous for the slide guide to be fastenable to a sash or door side member. However, it is also perfectly feasible for the slide guide to be fastened to an outer frame side member.

As it is independent of other parts of a fitting system, the device according to the invention is especially suited for subsequent attachment, i.e. for subsequent addition to a window or door.

In order to prevent problems in fastening the slide guide in the region of the sliding member, it is proposed that a tubular rivet be provided which passes through the slide guide and the sliding member and receives a fastening screw for fastening the slide guide to the first member, the purpose of the tubular rivet being to guide the sliding member and/or to restrict the movement of the sliding member and/or to support the resilient means. In this way at least two functions are carried out by one and the same component, i.e. the tubular rivet.

If the device is fitted in such a way that the axes of the sweivel and swivel-slide joints are parallel to the respective axis of rotation, the opening width can be varied merely by altering the position of the device on the respective member.

BRIEF DESCRIPTION OF THE DRAWINGS

The invention is illustrated, merely by way of example, in the accompanying drawings, in which.

DESCRIPTION OF THE PREFERRED EMBODIMENT

Figure 1:
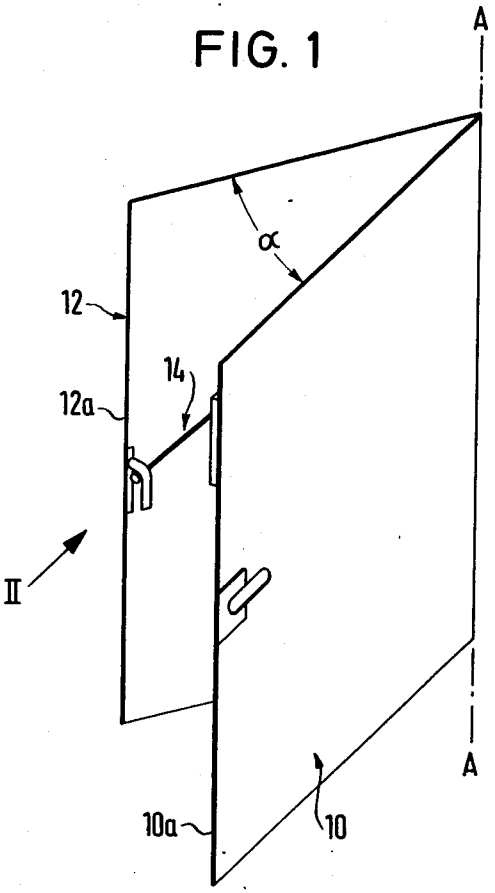
FIG. 1 is a schematic representation of a pivoted window fitted with a device according to the present invention.

FIG. 1 shows a pivoted window comprising a sash, which is generally indicated by the reference numeral 10, and a window frame, which is generally indicated by the reference numeral 12. The sash and window frame 10, 12 respectively have side members 10*a*, 12*a* which are remote from the axis of rotation A—A of the sash 10. Between the frame members 10*a*, and 12*a* there is provided a device 14 for fastening the sash 10 in a relatively open position in relation to the window frame 12, the device 14 allowing the sash 10 to be rotated about the axis A—A and into the said relatively open position in which it is disposed at an angle $\alpha$ to the window frame 12 and in which it will be fastened by the device 14.

Figure 2:
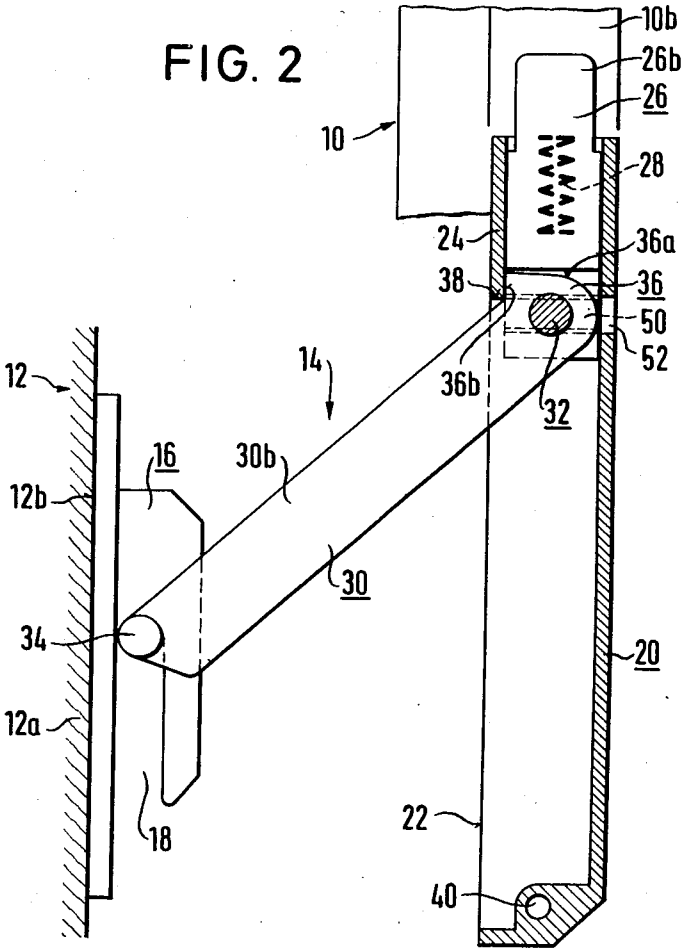
FIG. 2 is a view of the device shown in FIG. 1 and looking in the direction of the arrow II of FIG. 1, and is partially sectional along the line IV—IV of FIG. 5.

FIG. 2 shows the device 14 in more detail. On the window frame side member 12*a* a plate 16 is attached to the face area 12*b* of the window frame side member 12*a* and carries a rib defining an open-forked slide slot 18.

A housing or slide guide 20 of approximately square cross-section is attached to the sash 10 and more particularly to a peripheral retaining area 10*b* of the sash side member 10*a*. The housing 20 has an openng 22 in its side wall 24 facing the window frame side member 12*a*.

A sliding member 26 is arranged slidably in the housing 20. In FIG. 2 the sliding member 26 is shown in its uppermost or normal position and can be pushed downwards from its normal position against the action of a compression spring 28. An opening or swivel bar 30 is coupled to the sliding member 26 by means of a swivel joint 32. The opening bar 30 consists, as can be seen from FIG. 5, of two sections 30*a* and 30*b* which are held in position on either side of a downwardly pointing extension tongue 26*b* of the sliding member 26 by means of stub shafts 32*a*, 32*b* on the sliding member 26. The stub shafts 32*a* and 32*b* together form the swivel joint 32. At their ends remote from the swivel joint 32, the two sections 30*a*, 30*b* of the opening bar 30 are connected to each other by a slot engaging bolt 34 which is engageable in the open forked slot 18, the two sections 30*a* and 30*b* being arranged in FIG. 2 on either side of the plate 16. In FIG. 2 the sash 10 is fastened in relation to the window frame 12 by means, on the one hand, of the slot engaging bolt 34 engaging in the forked slot 18 and, on the other hand, of the opening bar 30 being immobilized in relation to the housing 20. A cam 36 is attached to the section 30*b*, there being a similar cam 36 attached to the section 30*a*. The cam 36 has a release curve 36*a* and a stop catch 36*b*. In FIG. 2 a cam engaging edge 38, which defines the upper end of the opening 22 in the side wall 24, is shown as being engaged with the stop catch 36*b*. While the sliding member 26 occupies the normal position shown in FIG. 2 through the action of the compression spring 28, the opening bar 30 cannot be swivelled in relation to the housing 20. This is the reason for the immobilization of the sash 10 in relation to the window frame 12.

If it is wished to transfer the sash from the predetermined relatively open position indicated in FIGS. 1 and 2 into a relatively closed position shown in FIG. 3, it is necessary merely to apply pressure to the sliding member 26, whose upper end 26*a* is formed as a push-button, until the release curve 36*a* of the cam 36 has moved below the cam engaging edge 38, so that the opening bar 30 can then be swivelled in the counter-clockwise direction according to FIG. 2. If the sash 10 is then brought nearer to the window frame 12, the swivel bar 30 rotates in the counter-clockwise direction around the swivel joint 32. After only slight counter-clockwise rotation, the pressure on the push-button 26*a* can be released, as the release curve 36*a* will then have moved into engagement with the cam engaging edge 38. As the sash 10 moves nearer to the window frame 12, the release curve 36*a* slides against the cam engaging edge 38, until it eventually reaches the position shown in FIG. 3.

Figure 3:
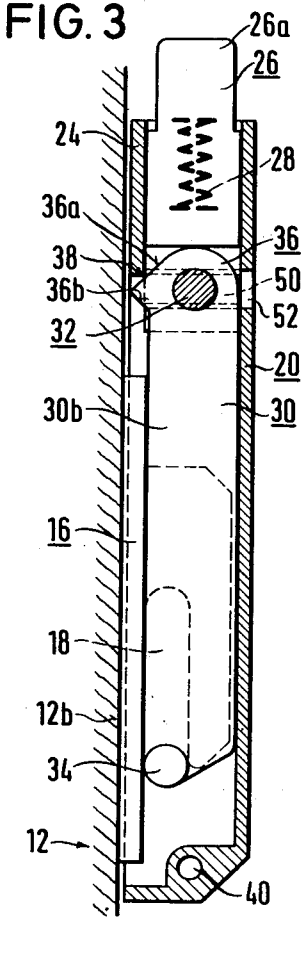
FIG. 3 is a view corresponding to that of FIG. 2 but with the sash of the said pivoted window in the closed position.

In the position shown in FIG. 3, the sliding member 26, thanks to the shape of the release curve 36*a*, has returned to its initial position (see FIG. 3). In FIG. 3 it can be seen that, when the sash is in the closed position, the slot engaging bolt 34 is still engaged in the open forked slide slot 18. This means that, when the sash is reopened in relation to the window frame in the direction of the predetermined relatively open position shown in FIGS. 1 and 2, it is ready to lock in that predetermined relatively open position. As the sash moves once again into the predetermined relatively open position of FIGS. 1 and 2, the release curve 36*a* rolls against the cam engaging edge 38, the sliding member 26 firstly being drawn downwards in relation to the normal position of FIG. 3 against the action of the compression spring 28, until the cam engaging edge 38 is able finally to engage the stop catch 36*b* of the cam 36, the sliding member 26 thus being returned to its normal position and the arrangement according to FIG. 2 once again being reached.

Figure 4:
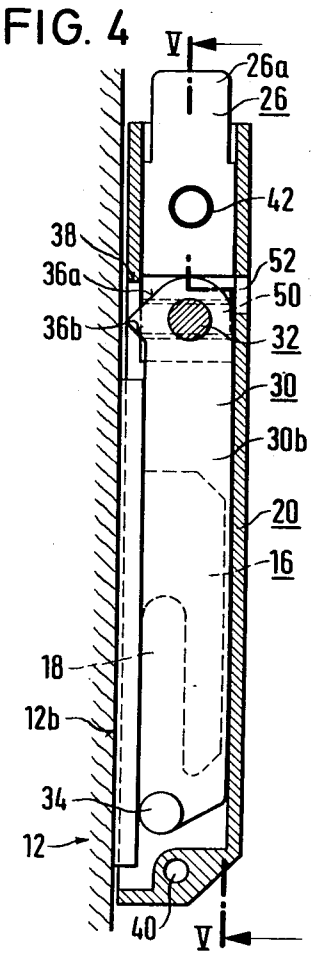
FIG. 4 is a view corresponding to that of FIG. 3 but with a sliding member of said device pressed down in preparation for a full opening of the sash.

It is possible to open the window beyond the predetermined relatively open position $\alpha$ shown in FIG. 1 by pressing the sliding member 26 downwards out of the position according to FIG. 3 and into the position of FIG. 4 before pivotal opening of the closed sash is begun. When pivotal opening of the sash then commences, the slot engaging bolt 34 can move laterally out of the slide slot 18 so that the slide joint 34, 18 becomes uncoupled.

Figure 5:
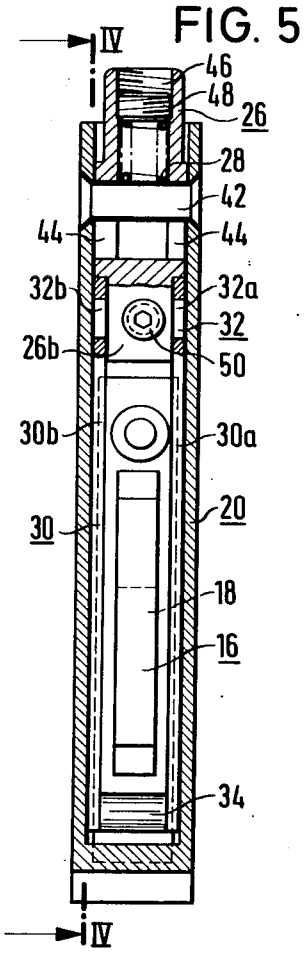
FIG. 5 is a cross-section taken on the line V—V of FIG. 4.

FIG. 4 shows a through-hole 40 through the lower end of the housing 20 and FIG. 5 shows a tubular rivet 42 passing through the upper end of the housing 20. The throughhole 40 and the tubular rivet 42 are designed to receive fastening screws (not shown) with which the housing 20 is attached to the peripheral retaining area 10*b*. The tubular rivet 42 passes through a slot 44 in the sliding member 26. In the upper end of the sliding member 26 there is formed a bore 46 which is closed by a stopper 48. Between the stopper 48 and the bore 46 there is housed the compression spring 28, one end of which engages a shoulder area of the stopper 48 and the other end of which engages the tubular rivet 42. In this way the compression spring 28 urges the sliding member 26 upwards into the position shown in FIGS. 2 and 3. In contrast, in FIGS. 4 and 5 the sliding member 26 is pressed downwardly against the action of the compression spring 28.

When the sliding member 26 is in the normal position, shown in FIGS. 2 and 3, a socket-head grub screw 50 located inside the sliding member 26 is in alignment with a hole 52 in the housing 20. By means of a socket-head screw wrench (not shown) the grub screw 50 can be screwed far enough out for its outer end to engage in the hole 52. It is then no longer possible to slide the sliding member 26 out of the normal position. This means that the sash can be secured at will in either the position according to FIG. 2 (the open position) or the position according to FIG. 3 (the closed position).

What is claimed is:

1. A device for detachably securing pivotally connected first and second members in a predetermined relatively open position into which they have been moved from a relatively closed position, the said device comprising a slide guide having a longitudinal direction adapted to be secured to the first member; a sliding member slidable in the longitudinal direction of said slide guide; resilient means in contact with the sliding member for urging the sliding member towards a normal position in the slide guide; a swivel joint carried by said sliding member; a rectilinearly extending swivel-slide joint fitting adapted to be secured to the second member; a bar one end of which is connectdd to the swivel joint and the other end of which is rectilinearly slidably connectable to and disconnectable from the swivel-slide joint fitting; a releasing and locking cam located on the bar, the slide guide having a cam-engaging edge therein which is engageable with the cam so as automatically to lock the bar in a predetrmined angular position only when the bar has been moved into the latter in a predetermined direction as a result of the first and second members having been moved into the said relatively open position; the cam having a cam surface which cooperates with the cam-engaging edge during the movement of the bar in the said predetermined direction to cause movement of the sliding member against the action of the resilient means until the bar is in the said predetermined angular position; and said sliding member includes a manually operable releasing means for effecting sliding movement of the sliding member away from the said normal position and against the action of the resilient means to release the cam from the cam-engaging edge and thus permit the bar to be swivelled around the swivel joint so that the first member may be moved from the relatively open to the relatively closed position; the bar being disconnectable from and removable out of a slot of the swivel-slide joint fitting when the first and second members are in the relatively closed position by moving the sliding member out of its normal position against the action of the resilient means; the bar being formed of two sections which are parallel to each other and which at one end receive the sliding member between them and at the other end are connected by a slot-engaging bolt, the swivel-slide joint fitting having a portion engaging between the two sections.

2. A device as claimed in claim 1 in which the first and second members are respectively constituted by a sash and an outer frame of a window.

3. A device according to claim 1 in which the releasing and locking cam has a release curve and a stop catch adjacent thereto.

4. A device according to claim 1 in which the swivel-slide joint fitting is formed with a forked slide slot open at one end thereof.

5. A device according to claim 1 in which the manually operable releasing means is located at the end of the sliding member which is remote from the bar and is formed as a manually operable releasing button.

6. A device according to claim 1 in which the slide guide comprises a cross-sectionally rectangular, elongate housing which receives the whole length of the bar when the first member is in the closed position and has an opening in a longitudinal side wall for the passage of the bar therethrough.

7. A device according to claim 6 in which an end edge of the said opening, which edge is close to the sliding member, is formed as the said cam engaging edge.

8. A device according to claim 3 in which in its normal position the sliding member is securable in relation to the slide guide; the bar, when the sliding member is in the normal position, being capable of assuming a position parallel to the first member and corresponding to the relatively closed position, of being locked in this parallel position by the cooperation of the release curve and the cam engaging edge, and the bar, when the sliding member is in the normal position, also being capable of being immobilized in the predetermined relatively open position by the cooperation of the stop catch and the cam engaging edge.

9. A device according to claim 1 in which a grub screw is provided in the sliding member, the grub screw being screwable into engagement with a corresponding opening in the slide guide.

10. A device according to claim 1 in which the device is formed symmetrically in relation to a plane of symmetry perpendicular to the axes of the swivel and swivel-slide joints.

11. A device according to claim 1 in which a tubular rivet is provided which passes through the slide guide and the sliding member and receives a fastening screw for fastening the slide guide to the first member.

12. A device according to claim 2 in which the predetermined relatively open position is an intermediate position between the relatively closed position of the window and the fully open position of the window.

* * * * *